United States Patent [19]

Goland

[11] 4,177,047

[45] Dec. 4, 1979

[54] ELECTROSTATIC PRECIPITATORS

[75] Inventor: Yaacov Goland, Pacific Palisades, Calif.

[73] Assignee: Joy Manufacturing Company, Pittsburgh, Pa.

[21] Appl. No.: 928,766

[22] Filed: Jul. 27, 1978

[51] Int. Cl.[2] ..... B03C 3/49; B03C 3/64

[52] U.S. Cl. ..... 55/146; 55/155; 55/DIG. 38

[58] Field of Search ..... 55/140, 146, 155, 156, 55/DIG. 38, 101, 435, 154; 428/408; 252/511

[56] References Cited

U.S. PATENT DOCUMENTS

| | | | |
|---|---|---|---|
| 2,705,544 | 4/1955 | Richardson | 55/140 |
| 3,120,453 | 2/1964 | Fitzer et al. | 428/408 |
| 3,203,849 | 8/1965 | Katz et al. | 428/408 |
| 3,750,373 | 8/1973 | Olson | 55/155 |
| 3,918,939 | 11/1975 | Hardt | 55/155 |
| 4,077,785 | 3/1978 | Hartshorn | 55/155 |
| 4,120,731 | 10/1978 | Hillig et al. | 428/408 |

FOREIGN PATENT DOCUMENTS

| | | | |
|---|---|---|---|
| 562893 | 7/1930 | Fed. Rep. of Germany | 55/DIG. 38 |
| 2130067 | 12/1971 | Fed. Rep. of Germany | 428/408 |

*Primary Examiner*—David L. Lacey
*Attorney, Agent, or Firm*—Thomas H. Murray

[57] ABSTRACT

An electrostatic precipitator is provided utilizing an improved material for the collecting electrodes and other elements of the precipitator. The new material is a fiberglass reinforced resin with a conductive and corrosion-resistant surface layer consisting of resin containing graphite powder and one or more veils, or thin mats, of graphite at or near the surface. A relatively highly conductive, corrosion-resistant surface layer is thus provided for the electrodes while the material is also a suitable structural material for other parts of the precipitator such as the casing. Tube sheets and supports for tubular collecting electrodes may also be made of this material with provision for grounding the electrode surfaces at both the top and bottom of the tubes.

11 Claims, 4 Drawing Figures

ELECTROSTATIC PRECIPITATORS

BACKGROUND OF THE INVENTION

The present invention relates to the construction of electrostatic precipitators, and more particularly to a conductive and corrosion-resistant material for the collecting electrodes and other parts of such precipitators.

Electrostatic precipitators consist of collecting electrodes, which may be tubes, plates or other suitable members, with associated high-voltage or corona discharge electrodes to maintain a strong electric field which places a charge on particles passing through it. The charge particles deposit on the adjacent collecting electrodes from which they may be removed in any suitable manner. In many cases, the collecting electrodes take the form of vertical tubes with a high-voltage electrode or wire extending centrally through each tube. Air or gas carrying particulate matter, or other impurities to be removed, passes through the tubes where the particles are charged and deposit on the inner surfaces of the tubes which are grounded or otherwise maintained at a sufficient potential difference from the high-voltage electrodes.

Precipitators of this type are frequently used for removing corrosive materials such as acid mists from air or other gas streams. The collecting electrodes and the enclosing casing must, therefore, possess a high degree of corrosion resistance and the electrodes must have good electrical conductivity. In conventional practice, such collecting electrode tubes and the casing walls have usually been made of, or lined with, lead which has good corrosion resistance to most acids, although it is not a desirable structural material, since it is soft and mechanically weak. The use of lead collecting electrodes and casing walls, therefore, has been common practice because nothing better was available. As an alternative to lead, it has been proposed to utilize fiberglass reinforced resins for the collecting electrodes of precipitators intended for this type of service. Such glass reinforced resins are good structural materials as they have high mechanical strength and can readily be fabricated into any desired sizes and shapes. This type of material, however, is an electrical insulator, and is not always sufficiently corrosion resistant. Fiberglass reinforced resin can be made conductive by mixing a sufficient quantity of graphite powder in at least the surface layers of the resin to give it some conductivity, and it has also been proposed to utilize thin graphite veils in place of the fiberglass reinforcement in the surface layer of the material. Both of these expedients provide some conductivity, but can cause fabrication difficulties and the specific resistivity and surface resistance are still undesirably high, which can cause high voltage gradients over the surface of the material and destructive sparking. The disadvantages of this type of material, therefore, have discouraged its use in electrostatic precipitators.

SUMMARY OF THE INVENTION

In accordance with the present invention, an electrostatic precipitator is provided using fiberglass reinforced resin with good electrical conductivity and high corrosion resistance, so that it is suitable for the collecting electrodes of the precipitator and is also suitable as a structural material for other members.

The collecting electrodes of the precipitator which may, for example, be vertical tubes, are made of this material which has good electrical conductivity in a surface layer as well as high corrosion resistance. The material itself is a fiberglass reinforced resin, which may be fabricated in the usual manner utilizing successive layers of glass fibers or mats impregnated with a suitable resin such as polyester and subsequently cured. For the purpose of the present invention, however, the material is provided with an integral conductive surface layer, at least on the collecting surface. The conductive surface layer consists of an integral layer of the resin with no glass but containing graphite powder, preferably in an amount of about 15% to 20% by weight, and also one or more graphite veils, that is, thin films or mats of graphite or graphite fibers, at or near the surface and extending substantially continuously over the entire surface. Such a surface layer has relatively lower resistivity so that the electrical conductivity is good, while the presence of the graphite veil provides high resistance to corrosion as well as contributing to the electrical conductivity, so that this material is particularly well suited for collecting electrodes for acid mists, for example. The new material has the good mechanical characteristics of glass reinforced plastics, so that it is suitable for other structural elements of the precipitator, such as the casing in which the electrode tubes are contained, and conductive surface layers may be provided where desired. The tube sheet in which the upper ends of the tubes are mounted, and the supports for maintaining alignment at the lower ends of the tubes, are also preferably made of this material with conducting surface layers in electrical contact with the conducting surface layers of the electrode tubes themselves. The tube sheet and lower support can then readily be grounded and in this way the tubes are also effectively grounded at both top and bottom so that no voltage gradient can exist from one end of the tube to the other.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
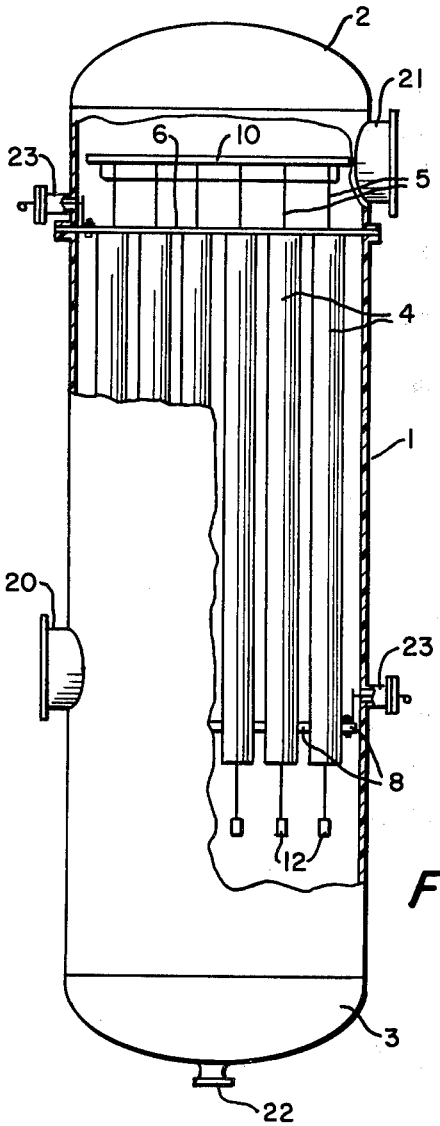
FIG. 1 is a view, in elevation, of a typical electrostatic precipitator embodying the invention, with the casing partly broken away.

The invention is shown in the drawings applied to an electrostatic precipitator primarily intended for removing acid mist from an air or gas stream, although the invention is, of course, of general application.

The illustrated precipitator has a casing or housing 1 in the form of a vertical cylindrical casing of suitable size. The casing 1 is closed by a top member 2 and a bottom member 3 which may be of any suitable construction adapted to be joined to the casing body 1 and sealed thereto. A plurality of tubular collecting electrodes 4 and high-voltage electrodes 5 are disposed vertically in the casing 1. Any suitable or necessary number of tubes 4 may be utilized and arranged in the casing in any desired manner. The upper ends of the tubes 4 are mounted in and supported by a tube sheet 6, and the lower ends of the tubes are aligned and supported by lower supports 8, as more fully described later. The high-voltage electrodes 5 consist of wires or rods extending through each tube 4 on its central vertical axis. The electrodes 5 are suspended from a frame 10 of any suitable construction and are electrically energized at the necessary high voltage. The electrical supply circuit has not been shown as it may be of any usual type and is not a part of the invention. The lower ends of the electrodes 5 may be positioned by weights 12 or by a supporting frame in the usual manner.

Figure 2:
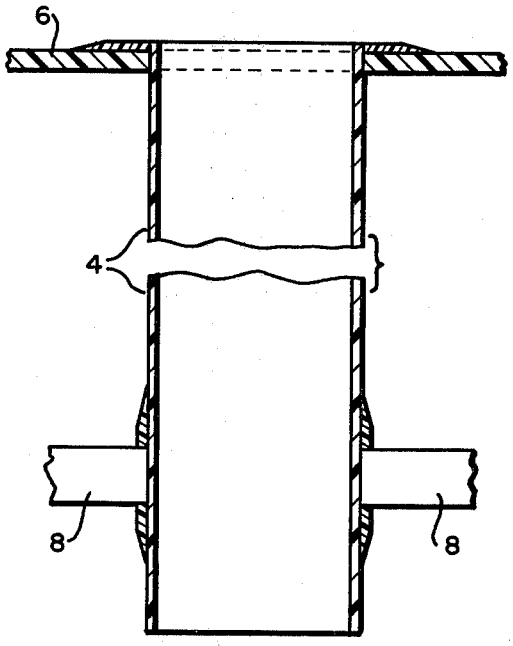
FIG. 2 is a view, in elevation, of a single collecting electrode tube and its mounting.

The collecting electrodes 4, as shown in FIG. 2, are tubes of suitable length and diameter through which the air or gas stream to be cleaned flows vertically upward. As previously discussed, the inner surface is the collecting surface of the tube and must have sufficient electrical conductivity to function as an electrode, and good corrosion resistance to withstand the effects of acid mists or other corrosive materials to be precipitated on the surface. In accordance with the present invention, the tubes 4 are made of a fiberglass reinforced resin which is an excellent structural material because of its high mechanical strength and its ease of fabrication, although such a material as conventionally made does not have the necessary characteristics stated above. Any suitable type of resin may be used, such as a polyester resin, and the tube may be fabricated in the usual manner by assembling or laying up layers of fiberglass material, such as glass cloth or mat, or glass fibers, which are impregnated with the resin and formed to the desired size and shape for subsequent curing of the resin, by heat and pressure or otherwise.

Figure 3:
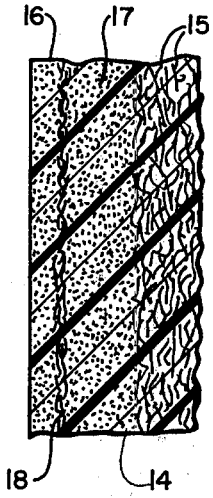
FIG. 3 is a greatly enlarged sectional view of the surface portion of a tube wall.

A material as just described is, of course, an electrical insulator, and since the glass is subject to attack by various acids, its corrosion resistance is poor as it depends entirely upon the protective coating of resin. This coating is subject to erosion by the sparking which frequently occurs in electrostatic precipitators, resulting in exposure of the glass to attack by corrosive substances. In accordance with the present invention, the material is provided with an integral, conducting surface layer which has the required low electrical resistivity and high corrosion resistance. As shown in the greatly enlarged sectional view of FIG. 3, the tube wall consists of a suitable resin 14 reinforced by layers of fiberglass, indicated at 15, and fabricated in the manner described above. An integral surface layer 16 is provided by applying a layer of the same resin 14 prior to curing so that it becomes integral with the body of the material during the subsequent cure. The surface layer 16 preferably extends over both inner and outer surfaces of the tube wall, to make both surfaces corrosion resistant, although it could be applied only on the inside of the tube where electrical conductivity is necessary. The surface layer 16 contains no glass but contains graphite powder, indicated at 17, mixed in the resin so as to be uniformly distributed. Enough graphite powder is used to provide the desired conductivity, the preferred amount being about 15% to 20% by weight. A graphite veil 18 is also included in the surface layer 16 and may be close to or at the outer surface thereof. The graphite veil 18 may be a thin mat of graphite fibers or a woven fabric, or may be a thin film or body of graphite formed in any desired manner, and extends substantially continuously throughout the surface area of the conductive layer 16. A single veil 18 may be utilized, or more than one veil may be provided, depending on the desired conductivity and on the thickness of the surface layer 16.

It has previously been proposed to increase the conductivity of glass reinforced resin by mixing grahite powder in the resin with which the glass is impregnated. Even with large amounts of graphite powder, however, such as 35% to 40%, the specific resistivity of this material was very high, being between 15 and 300 ohm-cm., which is much too high for precipitator electrodes. The use of graphite veils has also been proposed in non-conductive resins, but the specific resistivity thus obtained is still too high, while the surface resistivity may vary because of tearing of the veil. By utilizing graphite powder mixed in the resin, with no glass, and with the addition of one or more graphite veils as described above, very low specific resistivities can be obtained with consistent surface resistivity. Thus, with a graphite powder content of approximately 15% to 20% by weight, in combination with a graphite veil as described, specific resistivities in the range of 0.5 to 5 ohm-cm. can readily be obtained. Furthermore, the presence of the graphite veil or barrier at or near the outer surface results in very high corrosion resistance, since the graphite is not affected by most acids, which is not true of fiberglass. The combination of high corrosion resistance and low electrical resistivity of the surface layer described above makes the material very desirable for use as a collecting electrode surface, while the glass reinforced resin body of the material makes it an excellent structural material.

As mentioned above, the tubes 4 are mounted in the casing 1 by means of a tube sheet 6 in which the upper ends of the tubes are secured, and they are maintained in alignment and held in place at the lower ends by supports 8. The casing 1 and the top and bottom members 2 and 3 are preferably made of the fiberglass reinforced resin because of its good characteristics as a structural material, and a conductive surface layer as described above is provided in any area where it is necessary or desirable. In the operation of the precipitator, the air or gas stream to be cleaned enters the casing 1 through an inlet 20, which may be above the lower ends of the tubes 4, and is distributed to the lower ends of the tubes. The air stream flows upward through the tubes 4 where the suspended acid droplets, or other particulate matter, are charged by the electric field, and deposit on the tube walls, and the cleaned air or gas discharging through an outlet 21 in the top member 2. The deposited acid droplets or other material removed from the gas collect on the inner surfaces of the tubes 4 and may be removed by gravity, or by washing or spraying, or in any other manner, the material removed being drained out through a drain opening 22 in the bottom member 3. The high voltage electrodes 5 may be steel rods or wires coated with lead for corrosion resistance, or they may be fiberglass resin rods with a conductive surface layer as described above.

Figure 4:
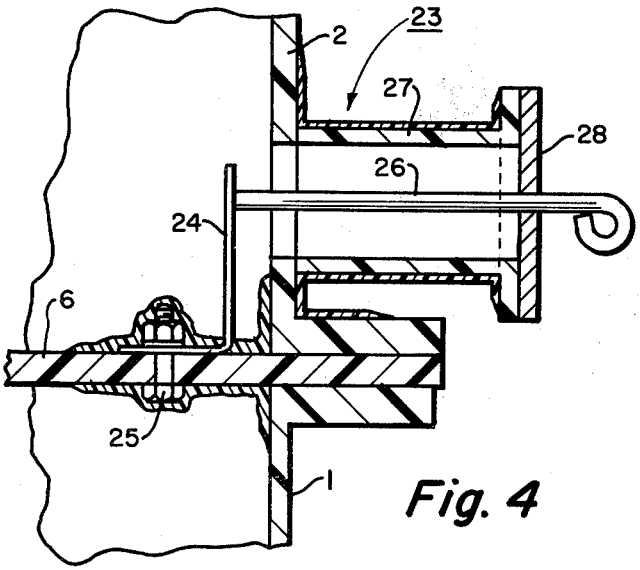
FIG. 4 is a fragmentary sectional view of a grounding connection.

The tube sheet 6, as shown in FIG. 2, is preferably also made of the glass reinforced resin with a conductive surface layer, as described above. The tube sheet may be of any desired size and configuration to fit in the casing 1, and may be clamped between flanges on the upper end of the casing 1 and the top member 2, as shown in FIG. 4. Each of the tubes 4 extends through an opening in the tube sheet 6 in which it fits closely, and the tubes are attached and sealed to the tube sheet, preferably by laminating them together. The tube sheet 6 may have conductive surface layers on either or both sides, and the conductive layers of the tube sheet are in contact with the conductive surface of each of the tubes 4 which preferably extends at least partially over the outside surface of the tube as well as the inside surface, as previously mentioned. The conductive layer of the tube sheet 6 may, however, be electrically connected to the conducting layers of the tubes 4 in any desired manner. The supports 8 at the lower end of the tube assembly may be support members of any desired type which engage the lower ends of the tubes 4 to maintain them in alignment and to hold them in position. The supports 8 are preferably also made of the same reinforced fiberglass material, and also preferably have conducting surface layers on either or both surfaces which are in electrical contact with the conducting surface layers of the tubes 4 in the same manner as described above. The outermost supports 8 may be laminated to the casing 1 or held in place in any other desired manner.

The collecting electrodes 4 must be maintained at the proper potential with respect to the high voltage electrodes 5, and for this purpose are preferably grounded. The use of the fiberglass-resin material described, with a highly conductive surface layer, for both the tubes 4 and the tube sheet 6 and supports 8 makes it possible to effectively ground both ends of each tube in a relatively simple manner by grounding means 23. As shown in FIG. 4, the tube sheet 6 is clamped between flanges on the casing 1 and top member 2 to secure it in position, and may be laminated to the casing. The grounding means 23 includes a conducting strap 24 of stainless steel, or other suitable conducting material, which is secured to the tube sheet 6 by a bolt 25 so as to be in electrical contact with the conductive surface layer of the tube sheet. The strap 24 is bent upwardly as shown and a stainless steel rod 26 is welded or otherwise attached to the upper end of the strap 24. The rod 26 passes through an opening in the housing and extends through a short tube 27 of glass reinforced resin which is closed at the outer end by a stainless steel plate 28. The rod 26 is welded in the plate 28, and the plate seals the end of the tube 27. The rod 26 is connected to ground in any desired manner. Preferably, grounding means 23 are provided at two or three equally-spaced locations around the circumference of the casing. The support members 8 at the lower end of the tubes 4 are preferably also grounded in the same manner by similar grounding means 23, so that the lower ends of the tubes are also effectively grounded. In this way, it is easily possible to ground both ends of each tube 4 so that no potential gradient can exist along the length of the tubes.

It will now be apparent that a very effective construction has been provided for electrostatic precipitators utilizing fiberglass reinforced resin as a structural material but with a conductive surface layer which is also highly corrosion resistant so that it very suitable for use for the collecting electrodes. The usefulness of this material is, of course, not limited to tubular electrodes as it may be used for flat plate electrodes or for any other purpose where its characteristics are desirable.

I claim as my invention:

1. An electrostatic precipitator comprising a casing made of corrosion resistant material and having a gas inlet and a gas outlet, a plurality of collecting electrodes, and a plurality of high-voltage electrodes, each of said collecting electrodes being made of an insulating resin reinforced with fiberglass and having an integral conductive surface layer on its collecting surface, said surface layer consisting of a layer of said resin containing graphite powder and at least one graphite veil substantially coextensive with the surface.

2. The electrostatic precipitator defined in claim 1 in which said surface layer contains between about 15% and about 20% by weight of graphite powder.

3. The electrostatic precipitator defined in claim 1 in which said graphite veil comprises a woven fabric of graphite fibers.

4. The electrostatic precipitator defined in claim 1 in which said graphite veil comprises a mat of graphite fibers.

5. The electrostatic precipitator defined in claim 1 in which said graphite veil comprises a thin film of graphite.

6. The electrostatic precipitator defined in claim 1 in which said collecting electrodes are tubular structures vertically disposed in the casing, and said high-voltage electrodes extend through the collecting electrodes centrally thereof.

7. The electrostatic precipitator defined in claim 6 in which said corrosion resistant material is said insulating resin reinforced with fiberglass with a conductive surface layer extending over at least a part of its surface.

8. The electrostatic precipitator defined in claim 6 and including means for connecting the conductive layers of said collecting electrodes to ground.

9. The electrostatic precipitator defined in claim 6 and including a tube sheet extending transversely in the upper part of the casing, said tube sheet being made of said insulating resin reinforced with fiberglass and having a conductive layer, said tubular collecting electrodes extending through said tube sheet and being sealed thereto with the conductive layers of the tubular electrodes and the tube sheet in contact, and means for connecting the conductive layer of the tube sheet to ground.

10. The electrostatic precipitator defined in claim 9 and further including support means for said tubular electrodes adjacent the lower ends thereof, said support means being made of said insulating resin reinforced with fiberglass and having a conductive layer in contact with the conductive layers of the tubular electrodes, and means for connecting the conductive layer of the support means to ground.

11. A collecting electrode adapted for use in conjunction with a high voltage electrode of an electrostatic precipitation apparatus to maintain an electrical field which is effective for electrostatic precipitation of contaminants from a flow of gas processed through such electrostatic precipitation apparatus, said collecting electrode comprising: an electrode body member formed to cooperate with such high voltage electrode to maintain such electrical field; said body member including a layer of insulating resin reinforced with fiberglass and having an integral conductive layer formed on the surface thereof with said conductive layer including a collecting surface on which such contaminants accumulate during electrostatic precipitation operations; and said conductive layer consisting of a layer of insulating resin containing graphite powder and at least one graphite veil substantially coextensive with said collecting surface.

* * * * *